US006442760B2

(12) United States Patent
Moretti

(10) Patent No.: US 6,442,760 B2
(45) Date of Patent: Sep. 3, 2002

(54) VENTILATED ITEM OF CLOTHING

(75) Inventor: Mario Polegato Moretti, Crocetta del Montello (IT)

(73) Assignee: Nottington Holding B.V., Amsterdam (NL)

( * ) Notice: Subject to any disclaimer, the term of this patent is extended or adjusted under 35 U.S.C. 154(b) by 0 days.

(21) Appl. No.: 09/765,604

(22) Filed: Jan. 22, 2001

(30) Foreign Application Priority Data

Jan. 31, 2000 (IT) ..... PD00A0026

(51) Int. Cl.[7] ..... A41B 1/00
(52) U.S. Cl. ..... 2/115; 2/69; 2/DIG. 1
(58) Field of Search ..... 2/115, 97, DIG. 1, 2/85, 87, 93, 94, 69, 108, 105

(56) References Cited

U.S. PATENT DOCUMENTS

| | | | | | |
|---|---|---|---|---|---|
| 2,697,832 | A | * | 12/1954 | Stich | 2/87 |
| 2,771,661 | A | * | 11/1956 | Foster | 28/80 |
| 2,781,820 | A | * | 2/1957 | Rogers | 154/28 |
| 3,045,243 | A | * | 7/1962 | Lash et al. | 2/1 |
| 3,213,465 | A | * | 10/1965 | Ludwikowski | 2/87 |
| 3,296,626 | A | * | 1/1967 | Ludwikowski | 2/87 |
| 3,703,432 | A | * | 11/1972 | Koski | 161/110 |
| 3,761,962 | A | * | 10/1973 | Myers | 2/79 |
| 3,783,451 | A | * | 1/1974 | Malin | 2/4 |
| 4,451,934 | A | * | 6/1984 | Gioello | 2/113 |
| 4,722,099 | A | * | 2/1988 | Kratz | 2/79 |
| 4,985,933 | A | * | 1/1991 | Lemoine | 2/84 |
| 5,014,363 | A | * | 5/1991 | Hubner et al. | 2/243 |
| 5,515,543 | A | * | 5/1996 | Gioello | 2/69 |
| 5,704,064 | A | * | 1/1998 | van der Sleesen | 2/69 |
| 5,727,256 | A | * | 3/1998 | Rudman | 2/115 |
| 6,070,274 | A | * | 6/2000 | van der Sleesen | 2/456 |
| 6,163,883 | A | * | 12/2000 | Hong | 2/69 |

FOREIGN PATENT DOCUMENTS

| | | |
|---|---|---|
| GB | 114596 | 4/1918 |
| GB | 2 329 103 | 3/1999 |
| WO | WO 01/01803 | 1/2001 |

* cited by examiner

*Primary Examiner*—Gloria M. Hale
*Assistant Examiner*—Alissa L. Hoey
(74) *Attorney, Agent, or Firm*—Oblon, Spivak, McClelland, Maier & Neustadt, P.C.

(57) ABSTRACT

An item of clothing, such as a coat, jacket, overcoat or the like, comprising:

spacer elements which are arranged at least in an internal part of the shoulders of the item of clothing so as to generate an interspace between the shoulders of the user and the fabric which the item of clothing is made of;

elements for venting warm air, produced by the user's body, that has risen in the interspace.

11 Claims, 1 Drawing Sheet

VENTILATED ITEM OF CLOTHING

BACKGROUND OF THE INVENTION

The present invention relates to a ventilated item of clothing such as a coat, jacket, overcoat or the like.

It is known that man wears clothing and shoes to protect his body from atmospheric agents such as snow, rain, wind and in particular from the cold.

The human body is protected mainly by resorting to various layers of clothing; the first one, underwear, is in direct contact with the body and is in turn covered by successive layers according to the outside temperature and to the environmental conditions.

Accordingly, it is sufficient to add or remove one or more layers of clothing to achieve comfort and find oneself at an optimum temperature.

The human body is inherently provided with "mechanisms" which help it to adapt thermally to the environment in which it is placed.

In the presence of overheating, for example, the body reacts by increasing perspiration which, by evaporating, allows a natural reduction in body temperature.

The heat generated by the human body, in addition to producing perspiration, is also dissipated externally by radiation.

This heat, which is always present, warms the air contained between the body and the item of clothing; the air, by rising, causes further overheating and discomfort, for example at the shoulders, which constitute regions of accumulation.

If water vapor is unable to escape from the protective enclosure that surrounds the human body (clothing), humidity increases until the vapor condenses and returns to the liquid state of perspiration, soaking the clothing starting from the underwear that constitutes the first inner layer.

This unpleasant drawback can currently be remedied by removing the wet item of clothing to replace it with a dry one, for example immediately after the end of a challenging mountain climb, but this causes a sudden cooling of the body and the danger of pneumonia and other chill-related diseases.

While on the one hand protection of the human body against the most adverse cold conditions is very effective by way of the use of highly insulating materials, on the other hand one cannot avoid noting the inability to allow the body to perspire naturally, ensuring the escape of the water vapor produced by perspiration.

Evidently, during the warm season the problem is more significant and forces many people to take several showers and change clothing continuously through the day.

An attempt has been made to solve these drawbacks by using clothing which has special vapor-permeability characteristics, for example by resorting to a material known commercially by the trademark "Gore-Tex" owned by the company W. L. Gore Ass. Inc.; however, such clothing is able to expel only a fraction, often a small fraction, of the vapor produced by sweating and generated by the human body, especially at the regions that are richer in sweat glands, and in any case is unable to ensure an effective changing of the air inside the item of clothing.

Vapor permeation in fact occurs to a limited extent, because a partial pressure of vapor sufficient to expel the sweat (in the vapor phase) outward does not form inside the layer of the item being worn.

In other cases, a remedy has been attempted by forming in the items of clothing openings which can be closed to varying extents at the regions where sweat concentrates most, for example under the armpits, but even this does not ensure particular effects, since actual air changing is not produced.

It should also be noted that the attempt to increase effectiveness by providing a larger number of openings also has not yielded satisfactory results.

In practice, in fact, some portions of the items of clothing always cling directly to the body, particularly the shoulders and chest, and therefore the water vapor generated by the evaporation of body sweat remains trapped between the body and the regions of the clothing that do not cling directly to the body (generally the abdominal region, the lumbar region of the back and most of all the region under the armpits), thus preventing its escape.

SUMMARY OF THE INVENTION

The aim of the present invention is to provide an item of clothing which solves the drawbacks noted above of conventional ones.

Within this aim, an important object of the present invention is to provide an item of clothing which ensures adequate air changing inside the protective enclosure that surrounds the body.

Another object of the invention is to allow, for all practical purposes, the natural thermoregulation of the human body.

This aim and these and other objects which will become better apparent hereinafter are achieved by an item of clothing, such as a coat, jacket, overcoat or the like, comprising:

spacer means which are arranged at least in an internal part of the shoulders of the item of clothing so as to generate an interspace between the shoulders of the user and the fabric which the item of clothing is made of;

elements for venting warm air, produced by the body of the user, that has risen in said interspace.

BRIEF DESCRIPTION OF THE DRAWINGS

Further characteristics and advantages of the present invention will become better apparent from the following detailed description of an embodiment thereof, illustrated only by way of non-limitative example in the accompanying drawings, wherein.

DESCRIPTION OF THE PREFERRED EMBODIMENTS

Figure 1:
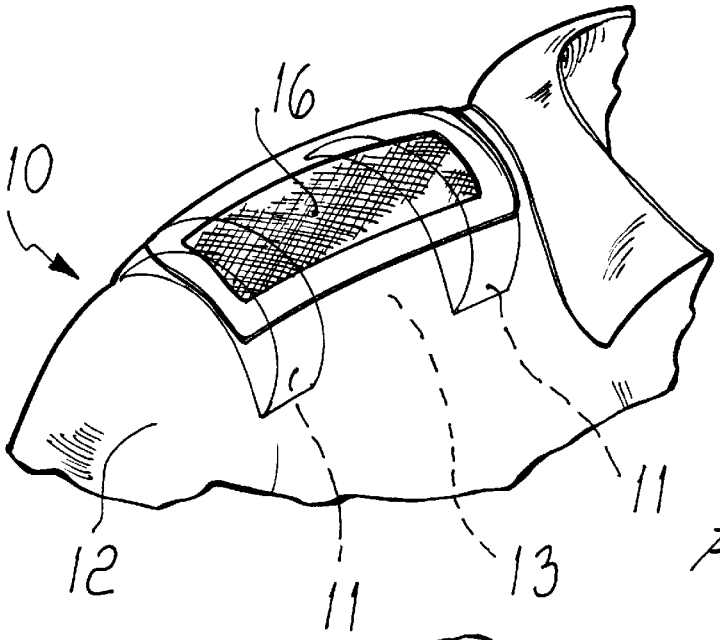
FIG. 1 is a perspective view, partially in phantom lines, of the upper part of an item of clothing according to the invention.
Figure 2:
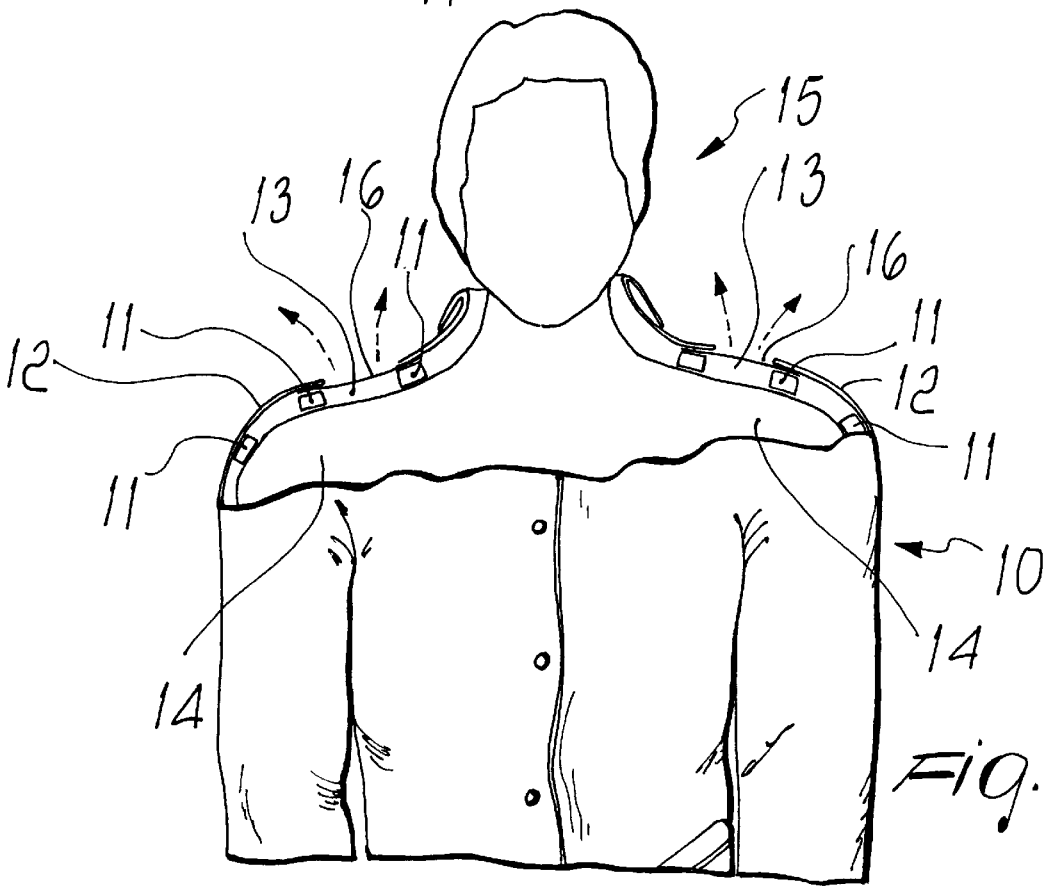
FIG. 2 is a partially cutout front view of the item of clothing of FIG. 1, shown being worn by a user.

With reference to the figures, an item of clothing such as a coat, jacket, overcoat or the like is generally designated by the reference numeral 10 and comprises spacer means 11 which in the specific case are constituted by elements made of soft material, such as terry, felt, non-woven fabric, woven fabrics (for example those known as "double jersey") or the like, joined to the item of clothing by means of stitched seams, Velcro couplings, zip fasteners, adhesives, et cetera, in the internal part of the shoulders 12 of the item of clothing so as to generate an interspace 13 between the shoulders 14 of the user 15 and the fabric which the item of clothing is made of.

By lifting the item of clothing 10 off the user's shoulders 14 by way of the spacer means 11, the water vapor or heat generated by the user's body no longer remain trapped in the abdominal region, in the lumbar region of the back and most of all in the region under the armpits, but tend to rise, encountering none of the obstacles currently formed by the regions in which the item of clothing clings to the body.

The item of clothing 10 further comprises elements 16 for venting the warm air, produced by the user's body, that has risen into the interspace 13; such elements are constituted, in this case, by a mesh 17 which is applied to a corresponding opening of each shoulder 12 of the item of clothing.

The mesh 17 can be conveniently combined, in a downward region, with a membrane which is impermeable to water and permeable to vapor, is not shown in the figures, and is for example of the type commonly known as Gore-Tex.

As an alternative, it is possible to provide per se known ventilation elements, for example of the type with a metallic ring which surrounds the edges of a corresponding hole of the item of clothing.

Accordingly, by combining the interspace 13 formed between the user's body and the item of clothing 10 by means of the spacers 11 with the air venting elements 16 one obtains outward expulsion of the warm air that has risen due to the stack effect above the shoulders 14.

By adjusting the extension of the area affected by the air venting elements 16 it is of course possible to adjust the amount of air expelled, so as to not cause problems in the natural thermoregulation of the human body.

In practice it has been observed that the intended aim and objects of the present invention have been achieved.

The invention thus conceived is susceptible of numerous modifications and variations, all of which are within the scope of the inventive concept.

All the details may furthermore be replaced with other technically equivalent elements.

In practice, the materials employed, so long as they are compatible with the contingent use, as well as the dimensions, may be any according to requirements.

The disclosures in Italian Patent Application No. PD2000A000026 from which this application claims priority are incorporated herein by reference.

What is claimed is:

1. An item of clothing, comprising:

spacer means which are arranged at least in an internal part of the shoulders of the item of clothing so as to generate an interspace between the shoulders of the user and the fabric which the item of clothing is made of;

venting elements for venting warm air, produced by the user's body, that has risen in said interspace, said venting elements being arranged at corresponding openings of the shoulders of said item of clothing, said venting elements being constituted by at least one mesh applied to said corresponding openings of the shoulders of said item of clothing; and said spacer means configured to lift said at least one mesh off the shoulders of the user by said spacer means.

2. The item of clothing according to claim 1, wherein said spacer means are elements made of soft material, which are joined to the item of clothing by means of stitched seams, hook and loop couplings, zip fasteners, adhesives and the like.

3. The item according to claim 1, wherein said mesh is combined, in a downward region, with a membrane which is impermeable to water and permeable to vapor.

4. The item according to claim 1, wherein said venting elements are constituted by ventilation elements which are constituted by metallic rings applied to said corresponding openings of the item of clothing.

5. The item of clothing according to claim 1, wherein said venting elements are continuously open for continuously venting air at the shoulders of said item of clothing.

6. The item of clothing according to claim 1, wherein said venting elements are combined, in a downward region, with a membrane which is impermeable to water and permeable to vapor.

7. The item of clothing according to claim 1, wherein said venting elements are continuously open for continuously venting air at the shoulders of said item of clothing, and wherein said venting elements are combined, in a downward region, with a membrane which is impermeable to water and permeable to vapor.

8. An item of clothing comprising:

spacer elements which are arranged at least in an internal part of the shoulders of the item of clothing so as to generate an interspace between the shoulders of the user and the fabric which the item of clothing is made of;

venting elements for venting warm air, produced by the user's body, that has risen in said interspace, said venting elements being arranged at corresponding openings of the shoulders of said item of clothing, said venting elements having at least one mesh which is applied to said corresponding openings of the shoulders of said item of clothing; and said spacer elements configured to lift said at least one mesh off the shoulders of the user by said spacer elements.

9. The item of clothing according to claim 8, wherein sand venting elements are continuously open for continuously venting air at the shoulders of said item of clothing.

10. The item of clothing according to claim 8, wherein said venting elements are combined, in a downward region, with a membrane which is impermeable to water and permeable to vapor.

11. The item of clothing according to claim 8, wherein said venting elements are continuously open for continuously venting air at the shoulders of said item of clothing, and wherein said venting elements are combined, in a downward region, with a membrane which is impermeable to water and permeable to vapor.

* * * * *

UNITED STATES PATENT AND TRADEMARK OFFICE

CERTIFICATE OF CORRECTION

PATENT NO. : 6,442,760 B2
DATED : September 3, 2002
INVENTOR(S) : Moretti

It is certified that error appears in the above-identified patent and that said Letters Patent is hereby corrected as shown below:

Title page,
Item [30], Foreign Application Priority Data should read:

-- [30] Foreign Application Priority Data

Jan. 31, 2000 (IT) …….. PD2000A000026 --

Signed and Sealed this

Fourteenth Day of January, 2003

JAMES E. ROGAN
*Director of the United States Patent and Trademark Office*